US005608367A

United States Patent [19]

Zoller et al.

[11] Patent Number: 5,608,367

[45] Date of Patent: Mar. 4, 1997

[54] MOLDED CASE CIRCUIT BREAKER WITH INTERCHANGEABLE TRIP UNIT HAVING BIMETAL ASSEMBLY WHICH REGISTERS WITH PERMANENT HEATER TRANSFORMER AIRGAP

[75] Inventors: Walter M. Zoller; David S. Hunter, Jr., both of Milwaukee; Edward L. Wellner, Colgate; Michael R. Larsen, Milwaukee; Peter J. Theisen, West Bend; Donald A. Link, Hubertus, all of Wis.

[73] Assignee: Eaton Corporation, Cleveland, Ohio

[21] Appl. No.: 565,764

[22] Filed: Nov. 30, 1995

[51] Int. Cl.[6] ..... H01H 67/02

[52] U.S. Cl. ..... 335/132; 335/202; 335/35

[58] Field of Search ..... 335/132, 202, 335/35, 23–25, 16, 147, 195; 218/22

[56] References Cited

U.S. PATENT DOCUMENTS 2,939,929 6/1960 Hobson, Jr. .
4,309,580 1/1982 Wafer et al. .
4,713,504 12/1987 Maier .
5,218,332 6/1993 Blanchard et al. ..... 335/132
5,258,733 11/1993 Link et al. .
5,321,365 7/1993 Kato ..... 335/132

*Primary Examiner*—Lincoln Donovan
*Attorney, Agent, or Firm*—Larry G. Vande Zande

[57] ABSTRACT

In a molded case circuit breaker with an interchangeable thermalmagnetic trip unit, the C-shaped heater transformer core is permanently held in place in the casing by a load bus strap with the gap in the core facing the trip unit. When the interchangeable trip unit is inserted into the molded casing, a magnetically permeable member mounted in the trip unit is aligned in the gap in the heater transformer core. The bimetal of the trip unit is fixed at one end to an electrically conductive sleeve surrounding the magnetically permeable member and forming the secondary of the heater transformer. The length of the magnetically permeable member is selected to establish the current conditions at which the bimetal trips the circuit breaker. The bus strap has an off-set section forming a first shoulder against which one wall of the housing of the interchangeable trip unit seats, and a second shoulder against which a pole piece backed by the heater transformer core seats to fix a gap between the pole piece and the armature in the interchangeable trip unit providing the instantaneous magnetic trip function.

10 Claims, 4 Drawing Sheets

MOLDED CASE CIRCUIT BREAKER WITH INTERCHANGEABLE TRIP UNIT HAVING BIMETAL ASSEMBLY WHICH REGISTERS WITH PERMANENT HEATER TRANSFORMER AIRGAP

BACKGROUND OF THE INVENTION

1. Field of the Invention

This invention relates to circuit breakers having a thermal-magnetic trip unit, and more particularly to such circuit breakers having a heater transformer for the bimetal providing the thermal trip capability.

2. Background Information

The thermal-magnetic trip unit of a common type of circuit breaker has a heater which heats the bimetal providing the thermal trip response in proportion to the current drawn by the load. This heater comprises a transformer having a laminated core forming a loop interrupted by a gap. The bus strap forming a conductor between the load terminal and the separable contacts of the circuit breaker passes through the transformer core to serve as a one turn primary winding for the heater transformer and an electrically conductive sleeve forms a one turn secondary winding. The bus strap induces a magnetic flux in the laminated core proportional to the current through the closed contacts of the circuit breaker. This magnetic flux in turn induces a secondary current which circulates in the electrically conductive sleeve and generates heat. The bimetal is secured at one end to the electrically conductive sleeve and is thus heated thereby. The free end of the heated bimetal is deflected to engage and release a latch mechanism which trips the circuit breaker open. The secondary current and the heat applied to the bimetal are directly related to the load current and inversely related to the gap in the laminated core of the transformer. Therefore, by appropriate selection of the initial gap between the cold bimetal and the latch mechanism, and the gap in the core of the transformer, the current/time characteristic of the thermal trip can be established.

In one such circuit breaker of this type, the laminated core is U-shaped and a steel cross member is secured across the ends of the U by screws extending into the laminations of the U-shaped member. Brass spacers between the ends of the U-shaped core and the cross member form the gap in the magnetic circuit which is adjusted by selection of the thickness of the brass spacers. This arrangement requires drilling and tapping holes into the ends of the laminations of the U-shaped core. In addition, the electrically conductive sleeve forming a secondary of the heater transformer is captured on the cross member.

In another type of bimetal heater, the laminated core is C-shaped and an iron bar partially fills the gap between the confronting legs of the C-shaped core with the length of the iron piece selected to provide the proper air gap, and therefore, selected reluctance for the magnetic circuit. The electrically conductive sleeve forming a secondary is long enough to bridge the total gap between the confronting legs of the C-shaped core, to therefore retain the sleeve permanently in place and to capture the iron bar. Electrical insulation is provided between the electrically conductive sleeve and the core and the iron bar.

In these thermal magnetic trip units, a steel pole piece is secured to the laminated core to concentrate flux in the direction of an armature spaced from the pole piece. Instantaneous load currents of a predetermined magnitude generate sufficient flux to attract the armature to the pole piece thereby also unlatching the trip mechanism to trip the circuit breaker.

It is desirable in many instances, to provide interchangeable trip units in a molded case circuit breaker so that the same frame can be used for installations requiring different rated currents. One means for providing a different current setting for the thermal trip, is to adjust the gap in the magnetic circuit of the heater transformer. In the above-described circuit breakers, this is not easily accomplished. It would be desirable to be able to have interchangeable trip units which could be easily inserted in the molded casing of such a circuit breaker to provide the desired range of current ratings.

There is a need therefore for improved circuit breaker having a thermal-magnetic trip with an electro-magnetic heater.

There is a more particular need for such an improved circuit breaker in which the thermal trip characteristic can be easily and reliably adjusted. There is a more specific need for such an improved circuit breaker in which the thermal trip characteristic can be adjusted by changing the gap in the magnetic core of heater transformer. There is a further need for such an improved circuit breaker in which different trip units may be interchangeably inserted and withdrawn with each providing a different gap in the magnetic circuit to provide a range of current ratings for the circuit breaker.

SUMMARY OF THE INVENTION

These and other needs are satisfied by the invention which is directed to molded case circuit breaker with interchangeable thermal-magnetic trip units. A heater assembly which implements the thermal trip function includes a heater core fixed in the molded casing of the circuit breaker by a bus strap which carries the interruptable current passing through the separable contacts of the circuit breaker. The heater core encircles the bus strap except for a gap facing the interchangeable trip unit. A heater element comprising a magnetically permeable member and an electrically conductive sleeve extending around the magnetically permeable member is mounted in the trip unit and positioned in the gap in the heater core when the trip unit is installed in the molded casing of the circuit breaker so that the permeable member extends across a selected portion of the gap in the heater core. A bimetal carried by the heater unit is heated by the secondary current induced in the electrically conductive sleeve to trip the operating mechanism of the circuit breaker and open the separable contacts in response to predetermined current conditions in the bus strap. The length of the magnetically permeable member is selectable to provide the selected current reading for the circuit breaker.

The trip unit also has an armature for tripping the operating mechanism to open the separable contacts in response to a predetermined instantaneous current in the bus strap. Thus, the circuit breaker includes a pole piece adjacent the heater core and spaced by an armature gap with the interchangeable trip unit inserted in the molded casing. The pole piece directs magnetic flux produced by current in the bus strap to attract the armature toward the pole piece to trip the operating mechanism in response to the predetermined instantaneous current.

Preferably the trip unit has an insulative housing which includes a first wall and a second wall spaced apart from the first wall and the bus strap has a first shoulder and a second shoulder with the first wall of the trip unit seating against the first shoulder on the bus strap with the trip unit inserted in the molded casing and with a pole piece seating against the second shoulder to thereby set the armature gap. The first wall of the trip unit is biased against the first shoulder on the bus strap by a spring bearing against the second wall. Preferably this spring is formed by one of the laminations of the heater core.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
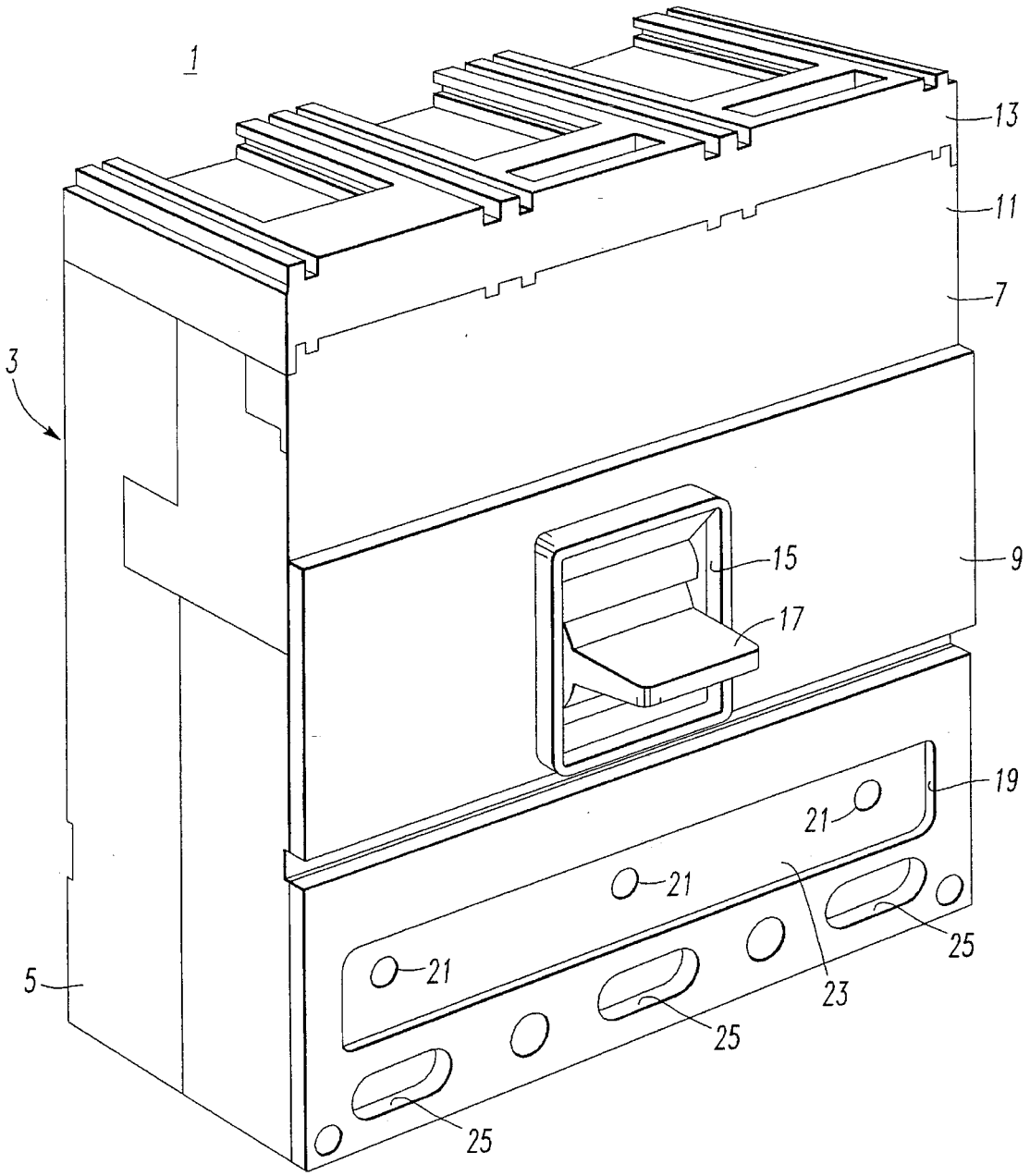
FIG. 1 is an isometric view of a molded case circuit breaker incorporating the invention.

FIG. 1 illustrates a circuit breaker 1 incorporating the invention. The circuit breaker 1 is a molded case circuit breaker having a multi-part molded insulative casing 3 comprising a base 5, an arc chamber housing 7, a cover 9, a terminal cover 11 and an extended lug cover 13. The cover 9 has a centrally located opening 15 through which an operating handle 17 extends. An elongated opening 19 provides access to magnetic trip adjustment knobs 21 on a trip unit 23. Three additional openings 25 at the bottom of the cover 8 provide access to load terminal lugs (not shown).

Figure 2:
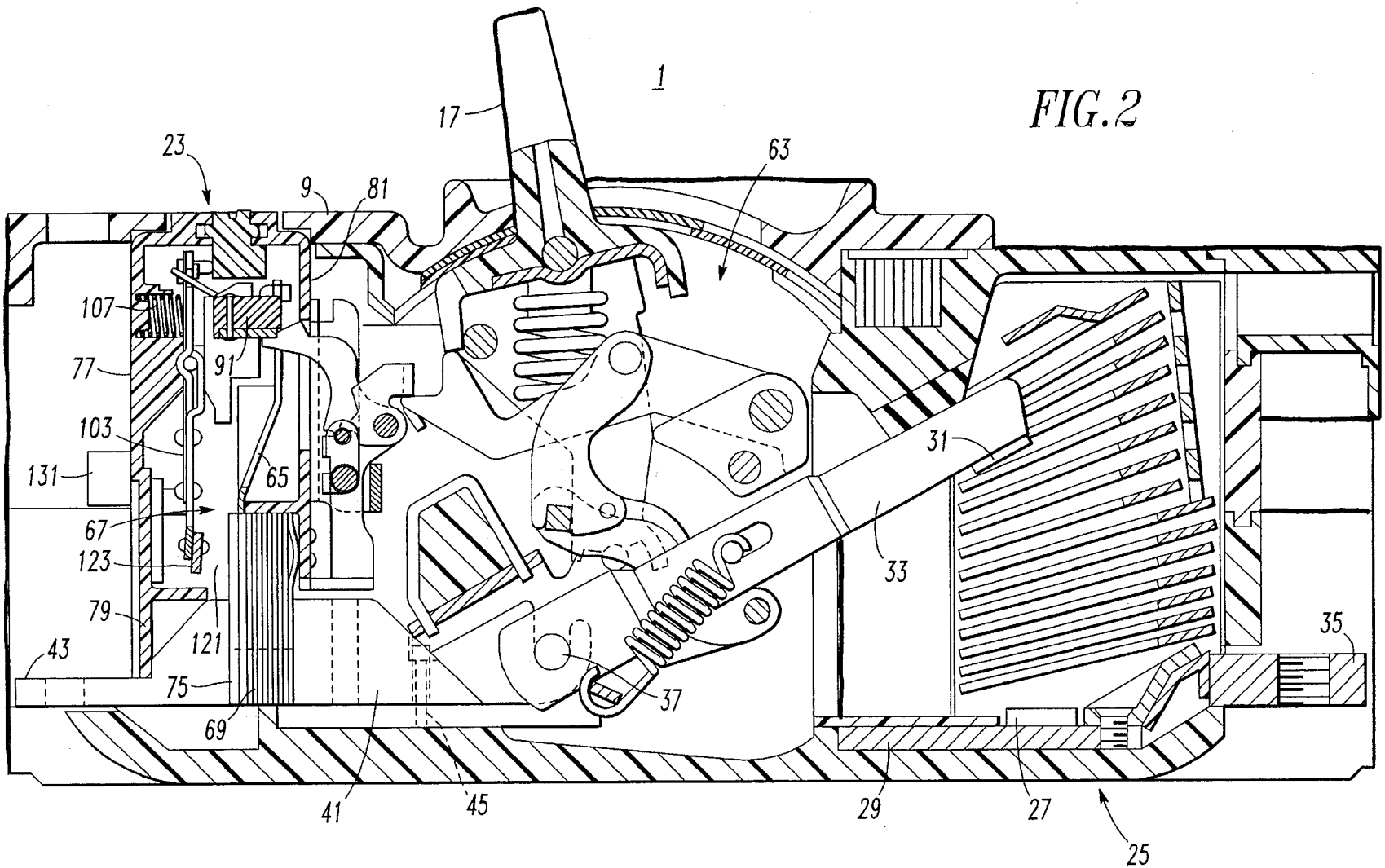
FIG. 2 is a vertical longitudinal section through the center pole of the circuit breaker FIG. 1.

The circuit breaker 1 is a three phase breaker having separate poles for interrupting current in each of the phases. As is well known in circuit breakers of similar design, the three poles are similar except that the center pole has an operating mechanism which is interconnected with the other poles by a common shaft. FIG. 2 is a longitudinal sectional view through the center pole of the circuit breaker 1. This pole includes separable contacts 25 comprising a fixed contact 27 mounted on a line side bus strap 29 and a movable contact 31 mounted on the end of a contact finger 33. The line side bus strap 29 terminates in a line terminal 35 for connection to an external source of AC power (not shown). The contact finger 33 has a pivot pin 37 which rotates in a pair of trunnions 39 on a load side bus strap 41. This load side bus strap 41 extends from the contact finger 33 through the trip unit 23 and terminates in a load terminal 43. The bus strap 41 is secured to the base 5 by screws (only one shown) passing through holes 45 and 47. The center section 49 of the load side bus strap 41 (see FIG. 4) is offset vertically from the terminal portion 51 and the contact support end 53. The offset center section 49 of the load bus strap 41 extends vertically upward from the load terminal section 51 to form a first shoulder 55 and then angles upward to an upper surface 57. The offset center section 49 of the bus strap 41 forms a passage 59 with the base 5 of the molded casing 3 and defines a second, internal shoulder 61 on the bus strap 41.

The contact finger 33 carrying the movable contact 31 is pivoted about the pivot pin 37 by an operating mechanism shown generally by the reference character 63. This operating mechanism is a well-known type such as that disclosed in U.S. Pat. No. 5,258,733. The operating mechanism can be manipulated manually by movement by the handle 17 to move the contact arm between the open position shown in FIG. 2 to a closed position (not shown) in which the separable contacts 25 are closed. The operating mechanism 63 can also be actuated automatically by the trip unit 23.

Figure 3:
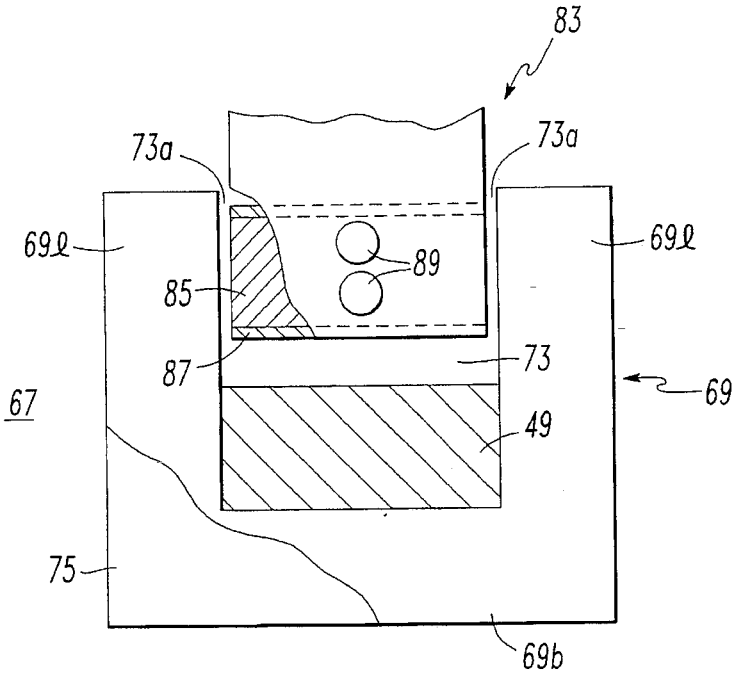
FIG. 3 is a partial cross-sectional view taken through the circuit breaker along the line 3—3 in FIG. 2 with parts broken away.
Figure 5:
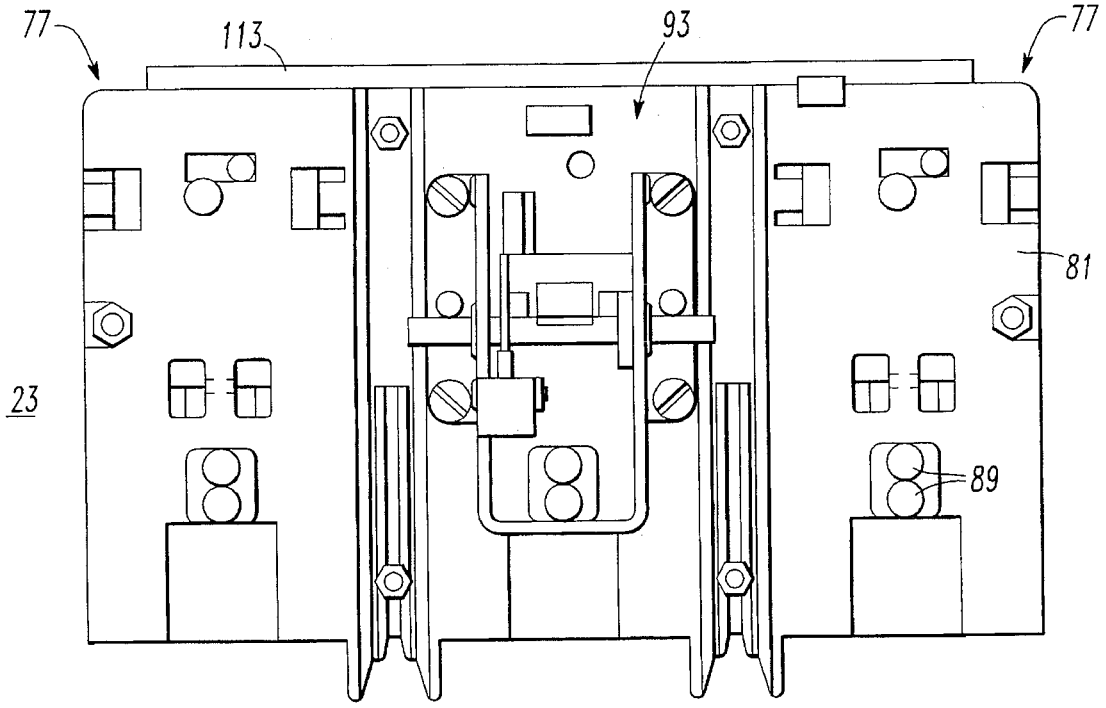
FIG. 5 is a back view of the trip unit shown in FIG. 4.

The trip unit 23 is a thermal-magnetic trip unit which responds to certain current conditions in the load side bus strap 41 to trip the operating mechanism 63 to open the separable contacts 25 and interrupt the current flowing to the load. The thermal trip function is provided by a bimetal 65 which responds to persistent overload currents, that is currents above the rated current of a circuit breaker which are present for an extended period of time. The overcurrent condition produces heat to which the bimetal responds. A heater transformer 67 generates heat as a function of the current passing through the load bus strap 41. This heater transformer 67 has a heater core 69 formed by a stack of laminations 71. The heater core 69 is U-shaped having a base **69*b* and a pair of legs 691 (see FIG. 3). This forms a gap 73 in the magnetic circuit which extends between the ends of the legs 691. The heater core 69 is mounted in the molded casing 3 by the load bus strap 41 which clamps the base 69*b* of the heater core against the base 5 of the molded casing. Thus, the bus strap 41 forms a one-turn primary winding for the heater transformer 67. A thick magnetic pole piece 75 is clamped next to the heater core 69 by the load bus strap 41**.

The heater core 69 is clamped in the base 5 with the gap 73 facing upward toward the trip unit 23. The trip unit 23 includes an insulative, generally rectangular, open bottomed housing 77 having a front wall 79 and a rear wall 81. This housing 77 may be formed of two molded halves secured by fasteners as in U.S. Pat. No.5,258,733. Mounted in the trip unit 23 is a heater element 83 which comprises a magnetically permeable member in the form of an iron bar 85. An electrically conductive sleeve in the form of copper cladding 87 surrounds the iron bar 85. The lower end of the bimetal 65 is secured to the copper sleeve 87 by a pair of rivets 89 which extend through the bimetal 65, the copper sleeve 87, the iron bar 85 and the second or rear wall 81 of the trip unit housing 77. An electrically insulative trip bar 91 extends laterally through the housing 77 and is mounted for rotation about its longitudinal axis in a manner described in U.S. Pat. No. 5,258,733. This trip bar 91 extends through all three poles of the circuit breaker. A latching mechanism 93 mounted on the outer wall 81 of the trip unit housing 77 has a trip lever 95 which extends through an opening 81a in the wall 81 toward the trip bar 91. As described in detail in U.S. Pat. No. 5.258.733, the latch mechanism 93 is engaged by the spring driven operating mechanism 63 which tends to rotate the trip lever 95 in the counter clockwise direction as viewed in FIGS. 2 and 4. However, the trip lever 95 has a short vertical surface **95*a* which is engaged by a metal latch plate 97 on the trip bar 91. With the trip lever 95 so engaged as shown in FIG. 2, it is prevented from rotating counter clockwise. The upper or free end of the bimetal 65 has an adjustment screw 99 which is aligned with a projection 101 on the trip bar 91**.

The magnetic trip function is provided by an armature 103. This armature 103 is an elongated stainless steel member which is mounted on a pivot pin 105 for rotation about a horizontal axis. The armature is biased for clockwise rotation about the pivot pin 105 by a helical compression spring 107. Tabs 109 adjacent the lower end of the armature 103 engage a magnetic shield 111 to form a stop setting a maximum clockwise position of the armature 103. This clockwise rotation can be limited by the magnetic adjustment knob 21 which is mounted for rotation about a vertical axis in the top wall 113 of the housing 77. This adjustment knob has an eccentric cam 115 which engages a calibration screw 117 extending laterally from the upper end of the armature 103. By rotating the magnetic adjustment knob 21, the clockwise rotation of the armature can be limited to less than that shown in FIG. 2. The calibration screw 117 allows for factory calibration of the magnetic trip. The upper end of the armature 103 passes through the bright of a wire bail 119 connected to the trip bar 91.

Figure 4:
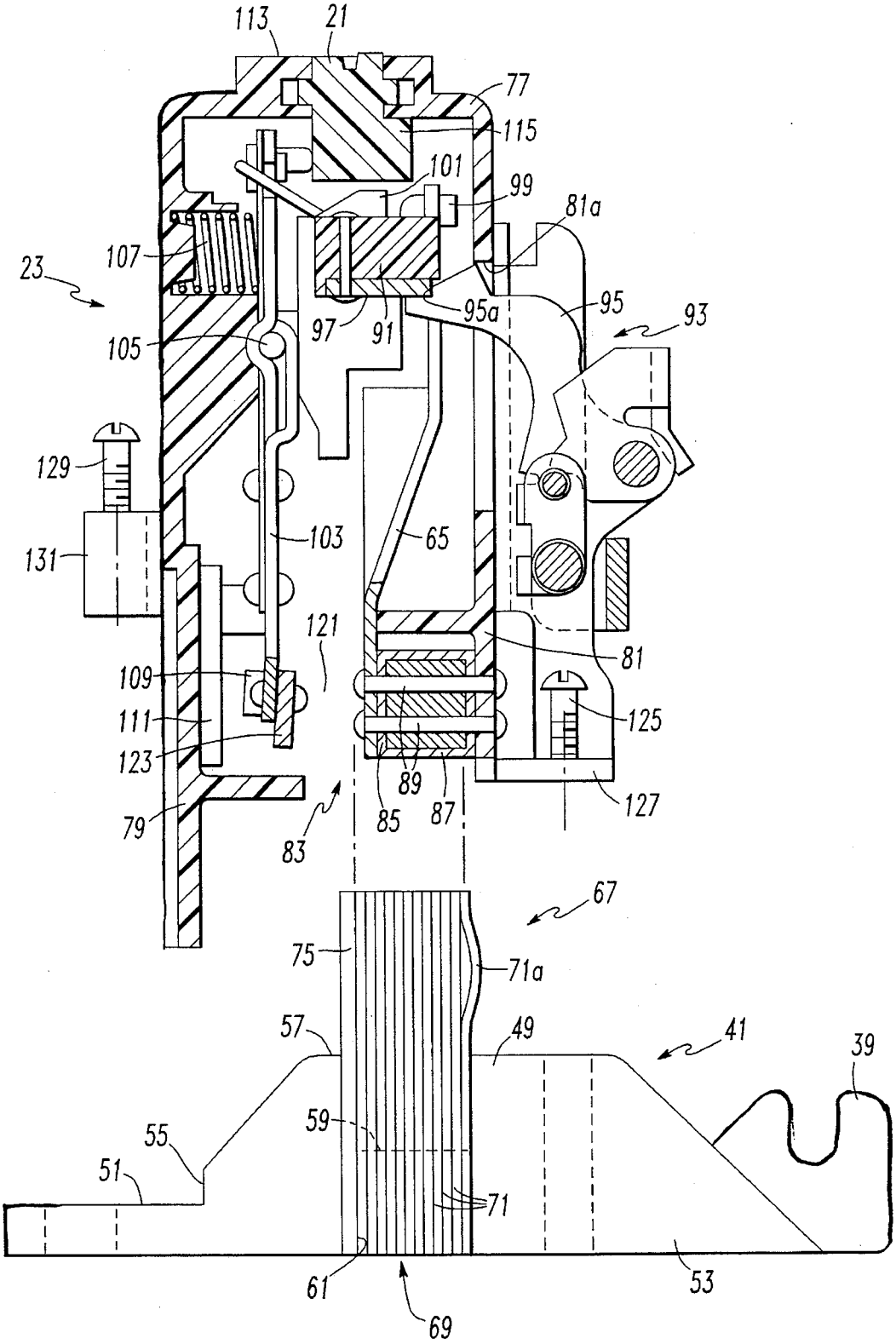
FIG. 4 is an enlarged exploded view of the trip mechanism which forms part of the circuit breaker shown partially withdrawn relative to the load bus strap within the current breaker.

Several different trip units 23 can be interchangeably used with the circuit breaker 1 to provide different current ratings for different installations. With the cover 9 removed, the selected trip unit 23 is inserted vertically as shown in FIG. 4 into the base 5 of the molded casing 3 as shown in FIG. 2. As the trip unit 23 is inserted, the iron bar 85 of the heater element 83 slips into the gap 73 in the heater core 69. Thus the large gap 73 is reduced to a selected smaller gap **73*a* (see FIG. 3). In order to align the iron bar 85, and with it the copper sleeve 87 and lower end of the bimetal 65 in the gap 73 and to properly position the armature relative to the pole piece 75, the first or front wall 79 of the housing 77 seats against the first shoulder 55 on the bus strap 41. The wall 79 is biased against this shoulder 55 by a leaf spring formed by the outer lamination 71a on the heater core 69. This reliably sets the magnetic gap 121 between the magnetically permeable member 123 secured to the lower end of the stainless steel armature 103 and the pole piece 75. The trip unit is fixed in the molded casing 3 by a screw 125 which clamps a bracket 127 on the latching mechanism 93 to the bus strap 41. In addition, a screw 129 clamps a slotted projection 131 on the front of the trip unit 23 to the molded casing 3**.

With the trip unit 23 in place, and the contacts 25 closed, the current passing through the bus strap 41 induces a magnetic field in the heater core 69. This magnetic flux in turn induces current in the copper sleeve 87 which is proportional to the current in the bus strap. This secondary current in the copper sleeve heats the copper sleeve which in turn heats the bimetal 65 causing the bimetal to bend in the counter clockwise direction as viewed in FIG. 2. Persistent current above the rated current of the circuit breaker causes the bimetal 65 to bend such that the adjustment screw 99 contacts the projection 101 and rotates the trip bar 91 in the counter clockwise direction. This lifts the metal latch plate 97 out of contact with the surface **95*a* on the trip lever 95 thereby allowing the trip lever to rotate counter clockwise as viewed in FIG. 2. This results in the operating mechanism 93 rotating the contact finger 33 to open the separable contacts 25. A cross bar in the operating mechanism rotates the contact fingers of all the poles so that the separable contacts 25 of all three phases are opened. The rated current for the circuit breaker is selected by selecting the length of the iron bar 85 which determines the length of the gap 73*a* in the heater core. Shortening the iron bar 85 increases the length of the gap 73*a* thereby increasing the reluctance of the heater core and raising the rated current. The adjusting screw 99** permits calibration of the thermal trip.

Short circuit currents through the bus strap 41 generate a magnetic field focused toward the armature 103 by the magnetic pole piece 75 of a sufficient magnitude to attract the magnetically permeable member 123 and rotate the armature in the counter clockwise direction. The upper end of the armature engages the bail 117 to rotate the trip bar counter clockwise and therefore trip the operating mechanism 63 to open the separable contacts in the manner discussed above in connection with a thermal trip. The amplitude of the current at which this occurs can be set by the length of the tabs 109 on the armature 103 with fine tuning of the individual poles made through rotation of the magnetic adjustment knobs 21.

The invention provides a quick easy arrangement for reliably selecting the rated current for a given circuit breaker frame. As the trip unit is inserted into the circuit breaker frame, the thermal trip element is aligned in the upwardly facing gap 73 in the heater core, and the magnetic gap 121 for the armature is reliably set by seating of the trip unit housing 77 against the shoulder 61 in the bus strap. The iron bar 85 carried on the trip unit does not have to be accurately centered in the gap 73, because it is the total length of the gap **73*a* at each end of the iron bar which is determinative of the coupling between the current in the bus strap and the current in the copper sleeve 87**. Typically, lengths of copper clad iron bar would be cut to the desired length to which a standard sized bimetal is riveted. This provides standardization of the parts with its attendant advantages.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a molded casing;

separable contacts mounted in said molded casing;

a bus strap connected to said separable contacts within said molded casing;

an operating mechanism mounted in said molded casing for opening and closing said separable contacts;

an interchangeable trip unit inserted in said molded casing for tripping said operating mechanism to open said separable contacts in response to predetermined current conditions in said bus strap, said trip unit including a bimetal; and a heater transformer comprising a heater core in said molded casing encircling said bus strap except for a gap in said heater core facing said trip unit, and a heater element comprising a magnetically permeable member and an electrically conductive sleeve extending around said magnetically permeable member, said heater element being mounted in said trip unit and positioned in said gap such that said permeable member extends across a selected portion of said gap with said trip unit inserted in said molded casing, said bimetal being carried by said heater element and heated thereby to trip said operating mechanism to open said separable contacts in response to said predetermined current conditions in said bus strap.

2. The circuit breaker of claim 1 wherein said magnetically permeable member has a selectable length extending across a selectable portion of said gap to select said predetermined current conditions in said bus strap at which said bimetal trips said operating mechanism.

3. The circuit breaker of claim 1 wherein said trip unit also has an armature for tripping said operating mechanism to open said separable contacts in response to a predetermined instantaneous current in said bus strap, said circuit breaker including a pole piece adjacent said heater core and spaced from said armature by an armature gap with said interchangeable trip unit inserted in said molded casing, said pole piece directing magnetic flux produced by current in said bus strap to attract said armature toward said pole piece-to trip said operating mechanism in response to said predetermined instantaneous current.

4. The circuit breaker of claim 3 wherein said trip unit has an insulative housing including a first wall and a second wall spaced apart from said first wall, wherein said bus strap has a first shoulder and a second shoulder, said first wall of said trip unit seating against said first shoulder on said bus strap with said trip unit inserted in said molded casing and said pole piece seating against said second shoulder to thereby set said armature gap.

5. The circuit breaker of claim 4 wherein said bus strap has an offset section providing clearance from said molded casing for said pole piece and heater core, said offset section forming said first and second shoulders.

6. The circuit breaker of claim 5 including a spring biasing said first wall of said trip unit against said first shoulder on said bus strap.

7. The circuit breaker of claim 6 wherein said spring comprises a lamination of said heater core bent to bear against said second wall of said trip unit to bias said first wall against said first shoulder on said bus strap.

8. The circuit breaker of claim 7 wherein said heater element is secured to said second wall of said trip unit.

9. The circuit breaker of claim 4 wherein said heater element is secured to said second wall of said trip unit.

10. The circuit breaker of claim 9 wherein said trip unit includes common fastener means securing said bimetal to said heater element and said heater element to said second wall.

* * * * *